US008497750B2

(12) United States Patent
Nazeri

(10) Patent No.: US 8,497,750 B2
(45) Date of Patent: Jul. 30, 2013

(54) RELEASE MECHANISM FOR CIRCUIT INTERRUPTING DEVICE

(75) Inventor: Christopher Nazeri, Prevessin (FR)

(73) Assignee: Secheron SA, Satigny (CH)

( * ) Notice: Subject to any disclaimer, the term of this patent is extended or adjusted under 35 U.S.C. 154(b) by 42 days.

(21) Appl. No.: 13/232,127

(22) Filed: Sep. 14, 2011

(65) Prior Publication Data

US 2012/0068794 A1 Mar. 22, 2012

(30) Foreign Application Priority Data

Sep. 20, 2010 (EP) ..... 10009927

(51) Int. Cl.
*H01H 83/00* (2006.01)

(52) U.S. Cl.
USPC ..... 335/14; 335/21; 335/234

(58) Field of Classification Search
USPC ..... 335/14, 21, 23, 220, 229, 234
See application file for complete search history.

(56) References Cited

U.S. PATENT DOCUMENTS

| | | | | |
|---|---|---|---|---|
| 3,024,330 | A | 3/1962 | Fehling | |
| 3,984,795 | A | 10/1976 | Gaskill | |
| 5,268,662 | A * | 12/1993 | Uetsuhara et al. | 335/229 |
| 5,381,121 | A * | 1/1995 | Peter et al. | 335/20 |
| 5,864,274 | A * | 1/1999 | Steingroever et al. | 335/234 |
| 5,959,519 | A * | 9/1999 | Gobel et al. | 335/179 |
| 6,853,100 | B2 * | 2/2005 | Yumita | 310/12.24 |
| 6,906,607 | B1 * | 6/2005 | Weber et al. | 335/303 |
| 6,940,376 | B2 * | 9/2005 | Morita et al. | 335/220 |
| 2002/0003462 | A1 * | 1/2002 | Stolk | 335/220 |

FOREIGN PATENT DOCUMENTS

| | | | |
|---|---|---|---|
| DE | 859337 | C | 12/1952 |
| DE | 918345 | C | 9/1954 |
| DE | 19715114 | A1 | 10/1998 |
| GB | 1439431 | A | 6/1976 |
| JP | 47015159 | U | 10/1972 |
| JP | 52053361 | U | 4/1977 |

OTHER PUBLICATIONS

European Search Report, dated Feb. 22, 2011, in EP 10 00 9927.

* cited by examiner

*Primary Examiner* — Bernard Rojas
(74) *Attorney, Agent, or Firm* — Young & Thompson

(57) ABSTRACT

A release mechanism for a circuit interrupting device includes a ferromagnetic main frame through which can flow a current and a ferromagnetic movable core designed to be translated in an opening of the main frame between a first position where the circuit interrupting device remains closed and a second position where the circuit interrupting device is opened. The release mechanism is designed to use the flux generated inside the main frame by the current flowing through it to displace the movable core between its first and second positions. The release mechanism further includes at least two permanent magnets mounted on the main frame on each side of the opening and relatively oriented so as to generate a unidirectional unique magnet flux inside the main frame and the movable core, the magnet flux creating a first force on the movable core that tends to maintain it in its first position.

23 Claims, 8 Drawing Sheets

RELEASE MECHANISM FOR CIRCUIT INTERRUPTING DEVICE

BACKGROUND OF THE INVENTION

1. Field of the Invention

The present invention pertains to an electromechanical release mechanism to be used in a circuit interrupting device such as a circuit breaker and in particular in a DC (direct current) circuit interrupting device.

2. Description of the Related Art

DC circuit interrupting devices generally comprise a stationary contact element and a movable contact element. Under normal conditions, these contact elements touch each other and electric current is conducted through them. To interrupt the current, the movable contact element is moved away from the stationary contact element thanks to a release mechanism.

Generally, the release mechanism opens the circuit interrupting device when a defined current through the circuit interrupting device is exceeded. It is usually a passive device to offer the highest level of protection and operates even on loss of auxiliary supply voltage. Most direct release mechanisms are electromechanical and use the magnetic field created by the current in the main circuit to activate a mechanical or magnetic trip system which moves the movable contact element away from the stationary contact element and opens the circuit interrupting device thus breaking the current in the main circuit.

One of the main requirements of the release mechanism is the speed at which it is activated. Because faults on a DC circuit, such as a traction network, can have high initial rate of rise (of about tens of kilo amperes per millisecond) these release mechanisms have to start opening the circuit interrupting device in less than five milliseconds in order to comply with international standards.

The majority of DC circuit interrupting devices, as the one used for traction applications, have fault or overcurrent conditions that are either non existent in the reverse direction of the main current or similar in the reverse direction of the main current and for this reason bi-directional release mechanisms are commonly used in these DC circuit interrupting devices. A bi-directional release mechanism operates in the same way in both directions of the current by using the magnetic flux from the main circuit with the current flowing in either direction to activate a mechanical trip.

There are however several protection standards which call for a unidirectional release mechanism that is actuated only upon detection of a reverse current. This means that the release mechanism will be activated and open the circuit interrupting device when the current flows through the said device in a first direction (reverse direction), but will not be activated by a current flowing in a second direction (forward direction), even under short circuit conditions. There may be a level in the forward direction for which the release mechanism will be activated but this is normally a fairly high value (which may be about 100 kA) in order to protect the circuit interrupting device itself from damages.

BRIEF SUMMARY OF THE INVENTION

The present invention aims at providing a release mechanism to be used in a circuit interrupting device, which is designed to operate differently depending on the direction of the current. A more particular aim of the present invention is to provide a release mechanism that is designed to open the circuit interrupting device very quickly when a current flows through it in a first reverse direction, but, to open the circuit interrupting device only when a current flowing through it in a second forward direction exceeds a very high value.

The object of the present invention is a release mechanism for a circuit interrupting device comprising a ferromagnetic main frame through which can flow a current and a ferromagnetic movable core designed to be translated in an opening of the main frame between a first position in which the circuit interrupting device is closed and a second position in which the circuit interrupting device is open; the said release mechanism being designed to use the flux generated inside the main frame by the current flowing through it to displace the movable core between its first and second positions; characterised in that it further comprises at least two permanent magnets mounted on the main frame on each side of the opening and relatively oriented so as to generate a unidirectional unique magnet flux inside the main frame and the movable core, the said magnet flux creating a first force on the movable core that tends to maintain it in its first position; and in that the permanent magnets, the movable core and the main frame are further conformed so that the movable core is displaced from its first position into its second position when a first current flowing through the main frame and generating a first flux inside the main frame and the movable core in the same direction as the magnetic flux exceeds a first limit value or when a second current flowing through the main frame and generating a second flux inside the main frame and the movable core in the direction opposite to the magnetic flux exceeds a second limit value, the said second limit value being different than the first limit value.

Another object of the present invention is a circuit interrupting device comprising such a release mechanism.

Thereby, the release mechanism according to the invention has different opening conditions depending on the direction and value of the current.

Preferably, the release mechanism according to the invention is set to open the circuit interrupting device very quickly when a current flows through it in a first reverse direction, that is when the said current exceeds a first fairly low value and to open the circuit interrupting device only at the last minute when a current flows through it in a second forward direction, opening it only when the said current exceeds a second fairly high value to protect the circuit interrupting device from damages.

Preferably, the release mechanism is set to open the circuit interrupting device when a reverse current exceeds about 4000 amperes and when a forward current exceeds about 100000 amperes.

BRIEF DESCRIPTION OF THE DRAWINGS

Other features and advantages of the present invention will become apparent in the following detailed description of one embodiment of the invention, with reference to the accompanying drawings, in which.

DETAILED DESCRIPTION OF THE PREFERRED EMBODIMENTS

Figure 1:
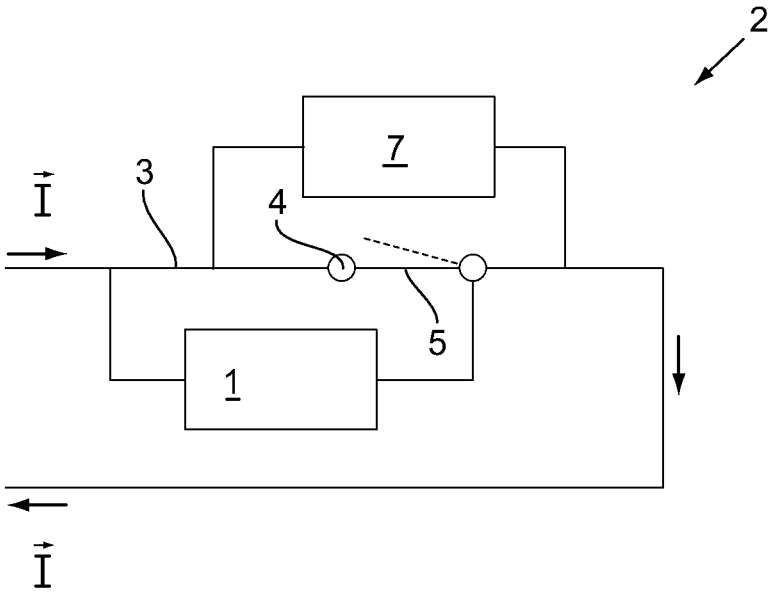
FIG. 1 is an electric diagram of a circuit interrupting device incorporating an electromechanical release mechanism according to the invention.

The release mechanism 1 according to the present invention is designed to be used in a conventional circuit interrupting device 2, such as a low or medium voltage circuit breaker. For example, such a circuit interrupting device 2 is schematically illustrated in FIG. 1 and traditionally comprises a circuit power line 3, a stationary contact element 4 and a movable contact element 5.

When the two contact elements 4, 5 are in contact with each other the current is conducted through the circuit power line 3 and through the circuit interrupting device 2. In this relative position of the contact elements 4, 5, the circuit interrupting device is said to be closed.

The release mechanism 1 according to the invention is designed to use the current flowing through the circuit interrupting device to activate an electro-mechanical trip system to move the movable contact element 5 away from the stationary contact element 4 and thus opening the circuit interrupting device 2 and interrupting the current.

For the sake of completeness, the circuit interrupting device 2 further comprises a blow-out device and/or an arc extinguishing chamber 7 to extinguish the electric arc created between the two separated contact elements 4, 5 when the circuit interrupting device is opened to totally interrupt the current. These components are well known to the person of ordinary skill in the art and won't be further described.

The release mechanism 1 according to the invention is illustrated in details in FIGS. 2 to 8*b* and comprises a main frame 8 and a movable core 13.

The main frame 8 has the shape of a polygonal open ring and is designed to surround the circuit power line 3 so that said line goes through the main frame 8. As it is an open ring, the main frame 8 presents a first and a second extremity 10, 11 defining between them an opening 12. The main frame 8 is rigidly fixed in a suitable way to the main body (not illustrated) of the circuit interrupting device 2 comprising the release mechanism 1.

Preferably, the main frame 8 is made by stacking layers of thin ferromagnetic laminations 8*a*. These laminations 8*a* are typically made of silicon steel for its good magnetic properties and are 0.5 mm thick. Each lamination 8*a* is insulated from its neighbours by a thin non conducting layer of insulating coating. It should be noted that for clarity purposes, the drawings only show some of the laminations 8*a* constituting the main frame 8.

A large amount of work has been done in the field of transformer core and the person of ordinary skill in the art will know to use this work in the making of the main frame 8. In particular, it is well known that the effect of the laminations 8*a* is to reduce the magnitude of eddy currents in the main frame 8. As for the number and the thickness of the laminations 8*a*, it is also well known that thinner laminations further reduce the losses due to eddy currents but are more laborious and expensive to construct.

The movable core 13 is designed so that it can be translated in the opening 12 between the first and second extremities 10, 11 of the main frame 8 along its longitudinal axis A parallel to the plane of the laminations 8*a* and perpendicular to the longitudinal axis of the circuit power line 3.

The movable core 13 and the main frame 8 have a complementary shape hereafter described.

On each of the first and second extremities 10, 11 of the main frame 8 is mounted a permanent magnet 14 respectively 15. Each of these magnets 14, 15 forms a first contact surface $S_{14}$, $S_{15}$ of respectively the first and the second extremities 10, 11. Each of these first contact surfaces $S_{14}$, $S_{15}$ of the respectively first and second extremities 10, 11 is designed to cooperate respectively with a corresponding first contact surface $S'_{14}$, $S'_{15}$ of the movable core 13 to determine a first abutment position of the said movable core 13 in the opening 12. The first abutment position of the movable core 13 is particularly illustrated in FIGS. 2, 3, 5, 6*a*, 6*b*, 6*c*.

The permanent magnets 14, 15 are oriented so that the first contact surfaces $S_{14}$, $S_{15}$ of respectively the first and the second extremities 10, 11 are opposite poles. Thus oriented, the two permanent magnets 14, 15 create a magnetic flux $F_M$ that flows through the main frame 8 and the movable core 13.

In the drawings, the orientation of each magnet 14, 15 is represented by arrows starting from the south pole of each magnet 14, 15 and pointing towards the north pole of each magnets 14, 15. Moreover, the first contact surface $S_{14}$ of the first extremity 10 of the main frame 8 is the south pole of one permanent magnet 14, while the first contact surface $S_{15}$ of the second extremity 11 of the main frame 8 is the north pole of the other permanent magnet 15. The magnetic flux $F_M$ flows then counter clockwise in the figures. The opposite is also clearly possible.

Furthermore, the first and second extremities 10, 11 of the main frame 8 present each a second contact surface $C_{10}$, $C_{11}$ cooperating respectively with a corresponding second contact surface $C'_{10}$, $C'_{11}$ of the movable core 13 to determine a second abutment position of the said movable core 13 in the opening 12. The second abutment position of the movable core 13 is pictured in FIG. 8*b*.

There are four general characteristics on the geometry of the contact surfaces of respectively the first and second extremities 10, 11 of the main frame 8 and the movable core 13:

1. Each of the first contact surfaces $S_{14}$, $S_{15}$ of respectively the first and the second extremities 10, 11 of the main frame 8 is essentially parallel to its corresponding first contact surface $S'_{14}$, $S'_{15}$ on the movable core 13. In the same way, each of the second contact surfaces $C_{10}$, $C_{11}$ of respectively the first and second extremities 10, 11 is essentially parallel to its corresponding second contact surface $C'_{10}$, $C'_{11}$ on the movable core 13.
2. When a magnetic flux flows through the main frame 8 and the movable core 13, the said flux passes perpendicularly through each of the first and second contact surfaces: that means that near said first and second contact surfaces, the flux lines are perpendicular to the said first and second contact surfaces. The first and second contact surfaces $S_{14}$, $S_{15}$, $C_{10}$, $C_{11}$ of respectively the first and second extremities 10, 11 are oriented so that the force that is generated by the flux passing through these surfaces has a component which is parallel to the longitudinal axis A of the movable core 13.

3. The first and second contact surfaces $S_{14}$, $C_{10}$ of the first extremity 10 are respectively and relatively oriented so that if a flux is passing through the first contact surface $S_{14}$ downwardly with respect to the axis A, the same flux will pass upwardly with respect to the axis A and vice versa. The same goes for the first and second contact surfaces $S_{15}$, $C_{11}$ of the second extremity 11.
4. When the movable core 13 is in its first abutment position, the first contact surfaces $S_{14}$, $S_{15}$, $S'_{14}$, $S'_{15}$ of respectively the first and second extremities 10, 11 of the main frame 8 and of the movable core 13 are in contact with each other along a common area, hereafter referred to as the first common area. In the same way, when the movable core 13 is in its second abutment position, the second contact surfaces $C_{10}$, $C_{11}$, $C'_{10}$, $C'_{11}$ of respectively the first and second extremities 10, 11 of the main frame 8 and of the movable core 13 are in contact with each other along a common area, hereafter referred to as the second common area. The first and second contact surfaces are arranged so that the said second common area is bigger than the first common area.

As will be explained hereafter in detail, the first three characteristics influence the direction of the force on the movable core 13 due to a flux passing through the main frame 8 and the movable core 13 while the last characteristic influence the magnitude of the said force. More precisely, characteristics 1 to 3 ensure that a flux passing through the first contact surfaces of both the main frame (8) and the movable core 13 creates a force that tends to attract the said surfaces against each other. The same goes for the second contact surfaces. The fourth characteristic is optional and ensure that the release mechanism will work properly even in extreme cases.

The movable core 13 can be considered as the assembly of two portions: the first portion 13*c* comprises the first contact surfaces $S'_{14}$, $S'_{15}$ of the movable core 13 but doesn't comprise the second contact surfaces $C'_{10}$, $C'_{11}$ and the second portion 13*d* comprises the second contact surfaces $S'_{14}$, $S'_{15}$ but not the first $C'_{10}$, $C'_{11}$. As illustrated in FIGS. 2, 3, 5, and 6*a* to 8*b*, the first portion 13*c* of the movable core 13 is its bottom half while the second portion 13*d* of the movable core is its upper half.

Figure 3:
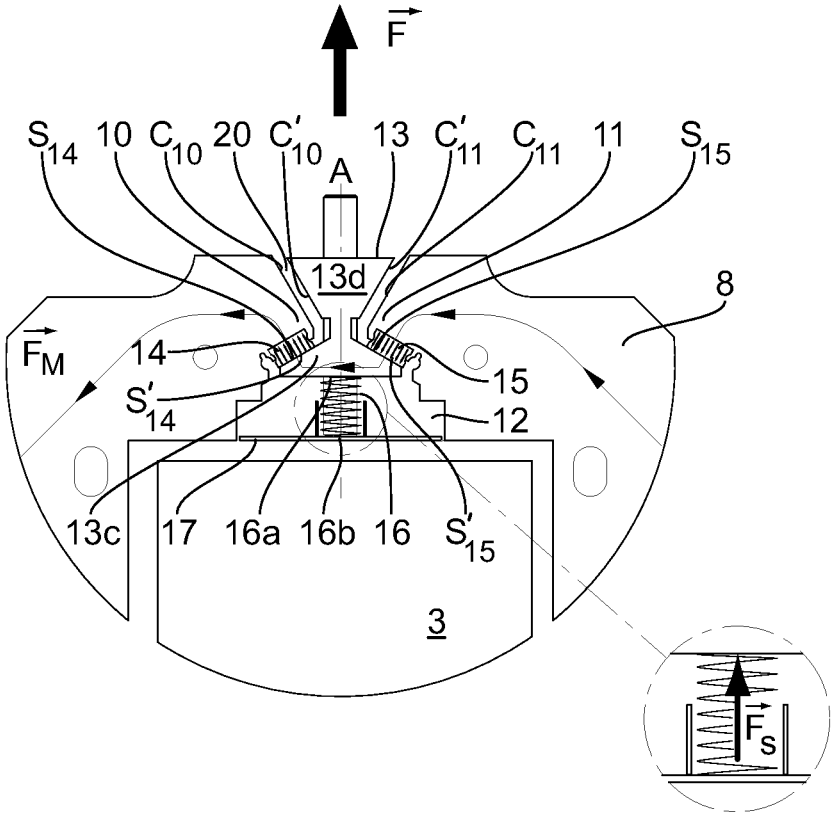
FIG. 3 is an enlarged view of the electromechanical release mechanism illustrated in FIG. 2.
Figure 4A:
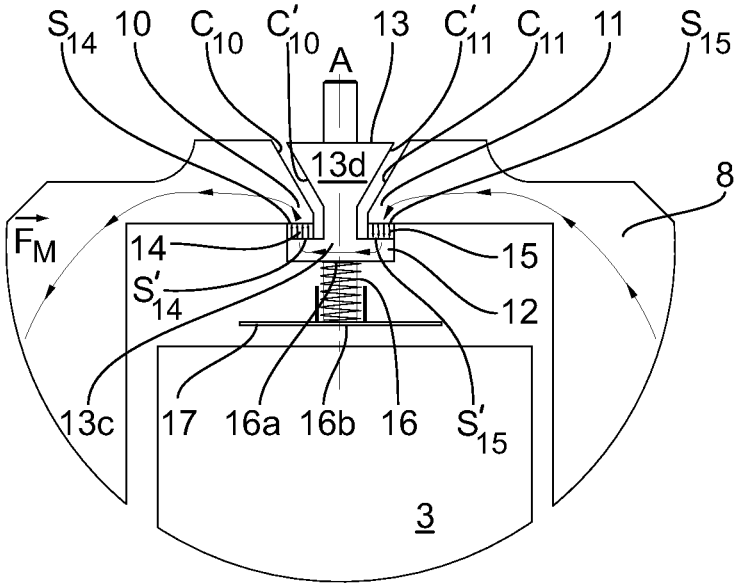
FIGS. 4*a*, 4*b* and 4*c* illustrate each a variant of the geometry of the release mechanism according to the invention.
Figure 4B:
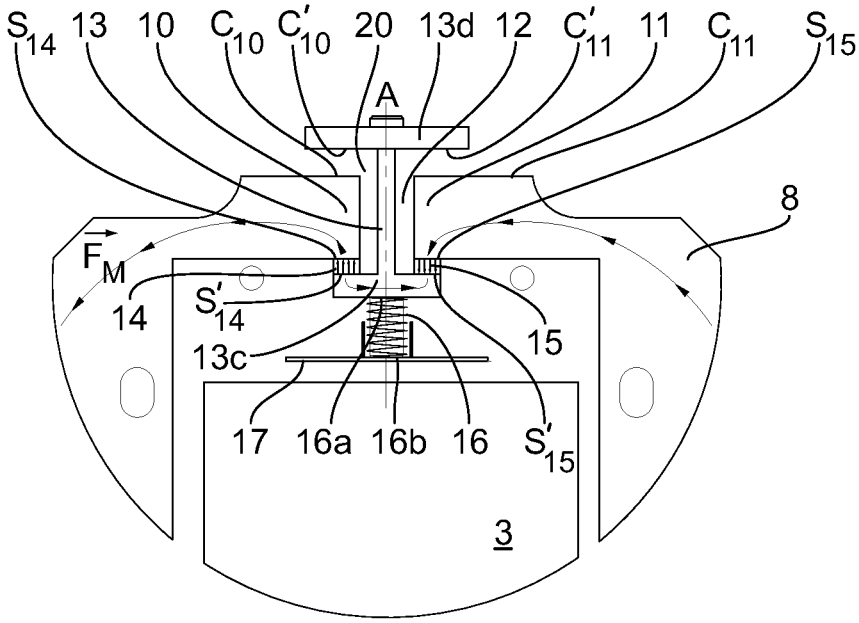
Figure 4C:
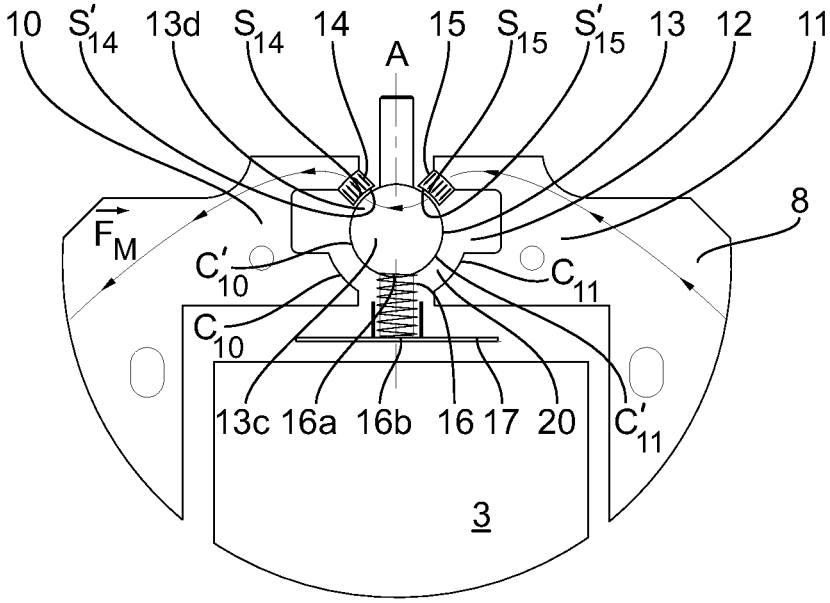
Figure 5:
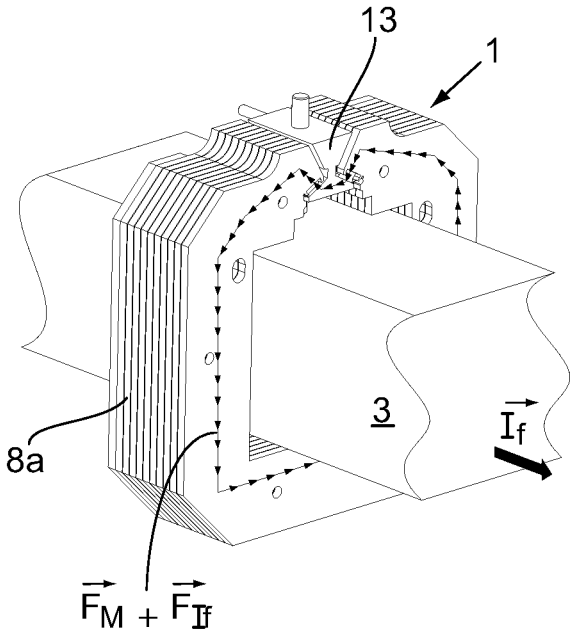
FIG. 5 shows the electromechanical release mechanism according to the invention when a forward current is flowing through the circuit interrupting device illustrated in FIG. 1.

In the main embodiment illustrated for example in FIG. 3, the movable core 13 has an hour glass shape and the extremities 10, 11 have an arrow head shape and are mirror images of each other. FIGS. 4*a* to 4*c* illustrate alternative possible shapes for the movable core 13 and the extremities 10, 11 and the corresponding position of the magnets 14, 15. Though those alternatives picture the first and second extremities 10, 11, respectively the first and second portion 13*c*, 13*d* of the movable core 13 as symmetric in shape, other alternatives are clearly possible.

Upon detection of a fault current in the power circuit line 3 the movable core 13 is translated in the opening 12 from its first to its second abutment positions. The movable core 13 is connected in a known way to the movable contact element 5 of the circuit interrupting device 2 to move said movable contact element 5 in a way that opens the circuit interrupting device 2.

When the movable core 13 is in its first abutment position, as pictured in FIGS. 2, 3, 5, 6*a*, 6*b*, 6*c*, the movable contact element 5 can be in contact with the stationary contact element 4 and thus the circuit interrupting device 2 can be closed, allowing the current to flow through it.

Figure 8A:
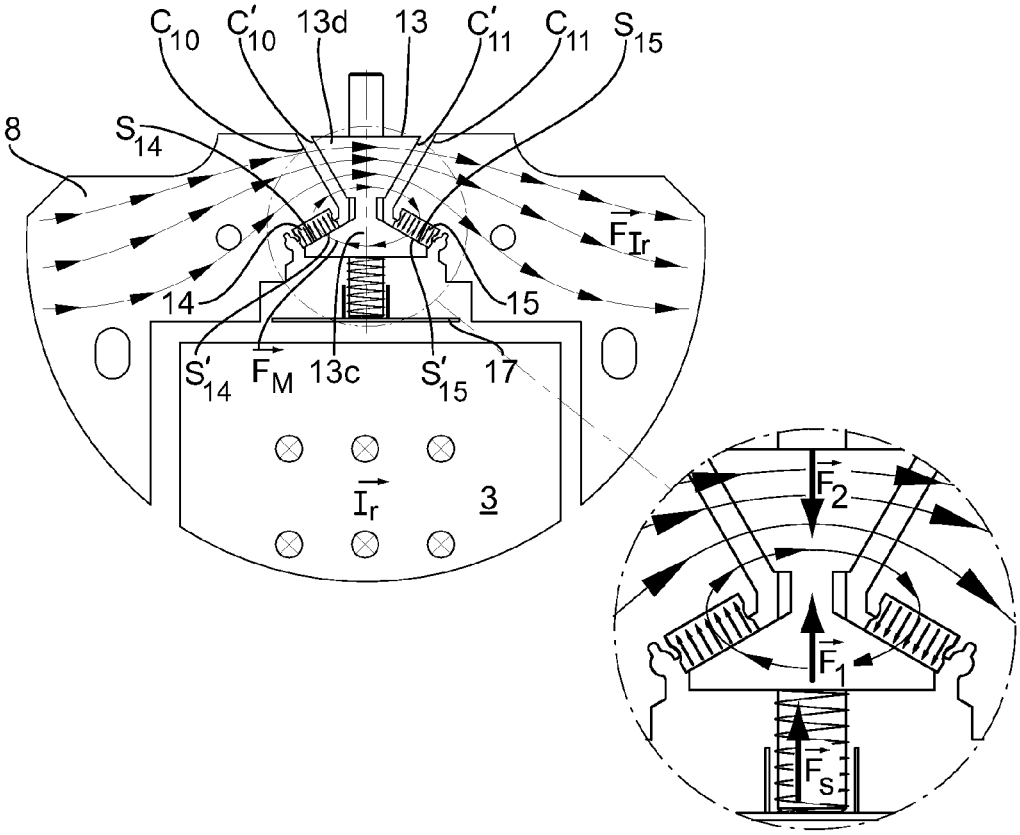
FIG. 8*a* is an enlarged view of the electromechanical release mechanism illustrated in FIG. 7 in a normal phase.
Figure 8B:
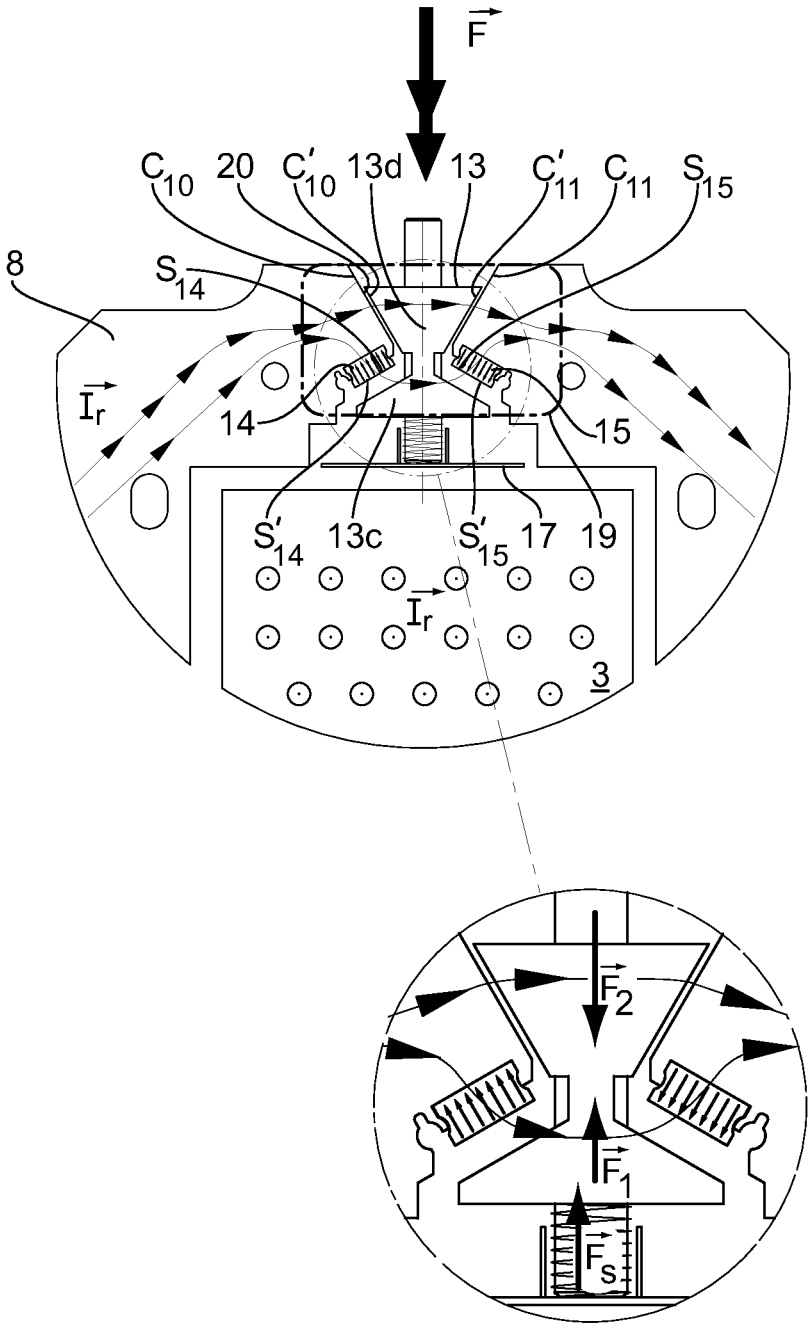
FIG. 8*b* is an enlarged view of the electromechanical release mechanism illustrated in FIG. 7 in an extreme phase.

When the movable core 13 is in its second abutment position, as pictured in FIG. 8*b*, the contact elements 4, 5 are space apart and the circuit interrupting device 2 is open, interrupting the current in the circuit power line 3.

Preferably, the release mechanism 1 according to the invention further comprises a reset spring 16 having a first extremity 16*a* connected to the movable core 13 and a second extremity 16*b* fixed upon a suitable support 17 of the main body of the circuit interrupting device 2. The reset spring 16 exerts a force $F_S$ along the longitudinal axis A of the movable core 13, directed upward in the figures, and tends to maintain the first contact surfaces $S'_{14}$, $S'_{15}$ of the movable core 13 pressed against their corresponding first contact surfaces $S_{14}$, $S_{15}$, of respectively the first and second extremities 10, 11 of the main frame 8 and thus the movable core 13 in its first abutment position. As will be explained below, the main function of the reset spring 16 is to move the movable core 13 back in its first abutment position once it has been displaced in the second abutment position. Another advantageous function of the reset spring 16 also explained below is allowing fine tuning of the release mechanism 1.

As with the prior art release mechanism, the release mechanism 1 according to the invention uses the magnetic flux created in the main frame 8 by the current flowing through the circuit power line 3 to move the movable core 13.

Figure 2:
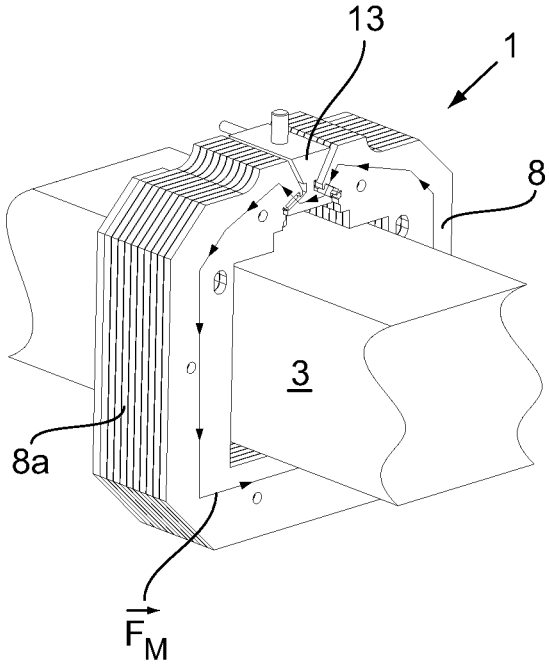
FIG. 2 shows an electromechanical release mechanism according to the invention when no current flows through the circuit interrupting device illustrated in FIG. 1.

FIGS. 2 and 3 illustrate the state of the release mechanism 1 at rest when no current flows through the circuit power line 3 and the circuit interrupting device 2. In this case, the only flux flowing through the main frame 8 of the mechanical release 1 is the magnetic flux $F_M$ due to the permanent magnets 14, 15 and the movable core 13 is in its first abutment position.

The magnetic flux $F_M$ passes in this state only through the first contact surfaces $S_{14}$, $S_{15}$, $S_{14}$, $S_{15}$ and so entirely through the first portion 13*c* of the movable core 13.

Due to the geometry of the contact surfaces (characteristics 1 to 3), the magnetic flux $F_M$ creates a force on the movable core 13 that is parallel to the axis A and upwardly directed in the figures. Indeed, the lines of the magnetic flux $F_M$ are essentially perpendicular to the contact surfaces and therefore there is an overall component which is parallel to the axis A and upwardly directed. The said force tends to keep the first contact surfaces $S_{14}$, $S_{15}$, $S'_{14}$, $S'_{15}$ of respectively the first and second extremities 10, 11 and the movable core 13 pressed against each other.

The overall resultant force F on the movable core 13 is then directed upward in the FIGS. 2 and 3 and is parallel to the longitudinal axis A of the movable core 13 and tends to maintain said movable core 13 in its first abutment position. Thus, the circuit interrupting device 2 is closed and remains so when no current is flowing through it.

FIGS. 5 and 6*a* to 6*c* illustrate the state of the release mechanism 1 when a forward current $I_f$ flows through the circuit power line 3 and the circuit interrupting device 2. As shown in the FIGS. 6*a* to 6*c*, the forward current $I_f$ is perpendicular to the plan of the paper and directed towards the reader.

Generally, the forward current $I_f$ generates a forward flux $F_{If}$ through the main frame 8 and the movable core 13. The direction of this forward flux $F_{If}$ is determined according to the right hand grip rule. So the flux $F_{If}$ flows counter clockwise in FIGS. 5, 6*a*, 6*b*, 6*c*. The permanent magnets 14, 15 are further oriented so that the magnetic flux $F_M$ created by the said magnets 14, 15 flows in the same direction as the forward flux $F_{If}$ generated by the forward current.

When the current flows in the forward direction, there are four phases hereafter described.

Figure 6A:
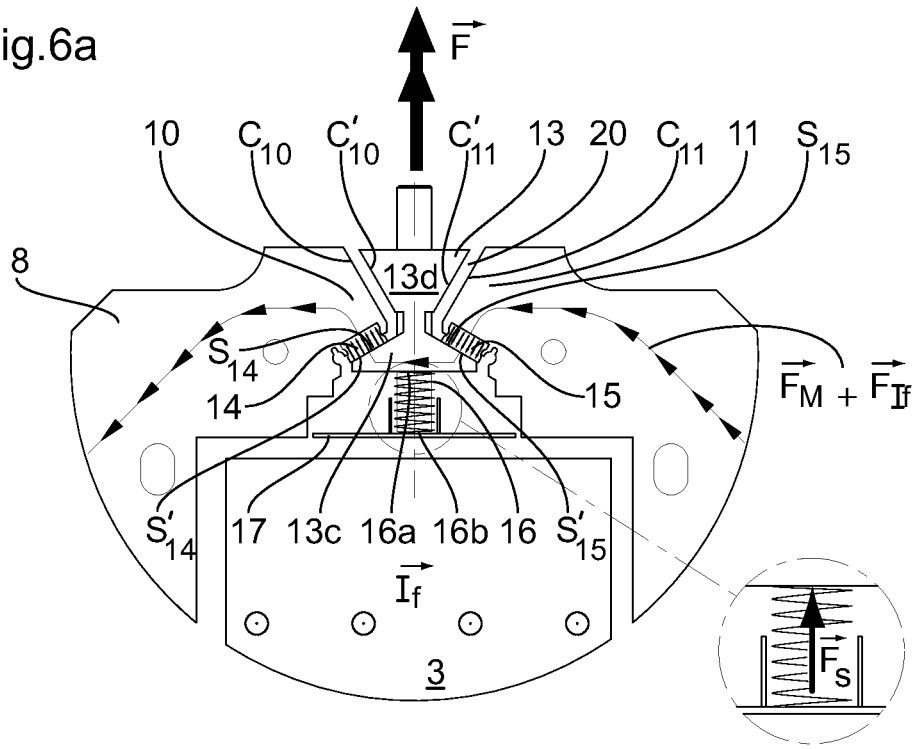
FIG. 6*a* is an enlarged view of the electromechanical release mechanism illustrated in FIG. 5 in a first phase.

In the first phase illustrated in FIG. 6*a*, when the forward current $I_f$ is low, the forward flux $F_{If}$ generated by the forward current $I_f$ reinforces the magnetic flux $F_M$ due to the permanent magnets 14, 15. The permanent magnets 14, 15 are strong enough to force the forward flux $F_{If}$ to pass through them. All the flux ($F_M$+$F_{If}$) flows then through the first portion 13*c* of the movable core 13. Due to the geometry of the contact surfaces (characteristics 1 to 3), the total flux $F_M$+$F_{If}$ flowing through the main frame 8 and the movable core 13 creates a force on the movable part 13 that is parallel to the axis A and upwardly directed in the figures. The overall resultant force F on the movable core 13 is then directed upward in the FIG. 6*a*, parallel to the longitudinal axis A of the movable core 13 and tends to maintain more strongly said movable core 13 in its first abutment position. Thus, the circuit interrupting 1 device remains closed.

Figure 6B:
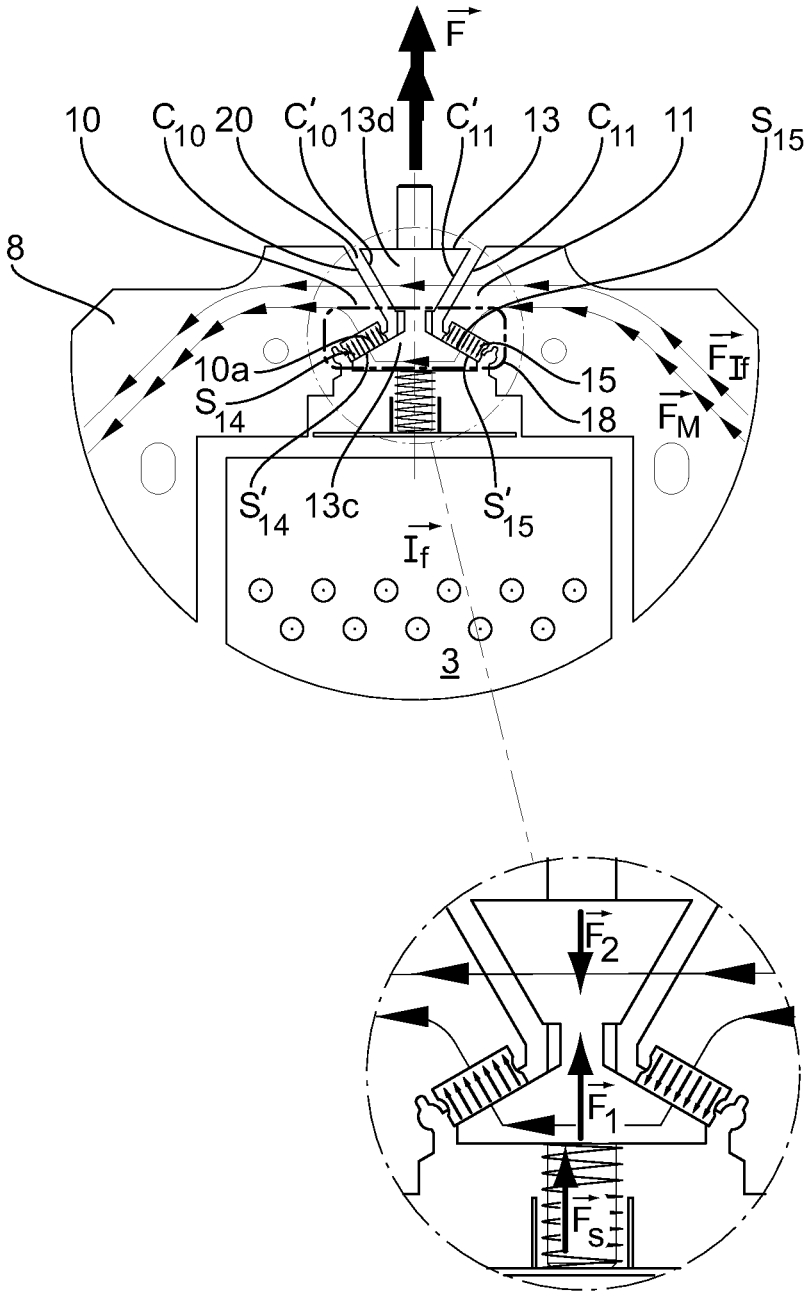
FIG. 6*b* is an enlarged view of the electromechanical release mechanism illustrated in FIG. 5 in a second phase.

In the second phase illustrated in FIG. 6*b*, a zone 18 comprising the first portion 13*c* of the movable core 13 through which flows the magnetic flux $F_M$ reinforced by the forward flux $F_{If}$ and the permanent magnets 14, 15 becomes saturated as the current $I_f$ increases. Reference numeral 18 in FIG. 6*b* designates schematically this saturated zone. Some of the forward flux $F_{If}$ starts to flow through the second portion 13*d* of the movable core 13. A first force $F_1$ is created on the movable core 13 by the magnetic flux $F_M$ and the part of the forward flux $F_{If}$ saturating the zone 18 (i.e. the part of the overall flux flowing through the first contact surfaces and the first portion 13*c* of the movable core 13). As the zone is saturated, this first force $F_1$ reaches its maximum. A second force $F_2$ is exerted on the movable core 13 due to the part of the flux passing in the second portion 13*d* of said movable core 13 and is parallel to the axis A (due to the second characteristic on the geometry of the movable core 13 and the main frame 8). The said second force $F_2$ tends to attract the second contact surfaces $C'_{10}$, $C'_{11}$ of the movable core 13 against their corresponding second contact surfaces $C_{10}$, $C_{11}$ of the extremities 10, 11 (due to the third characteristic on the geometry of the movable core 13 and the main frame 8). Hence this second force $F_2$ is directed downward in the FIG. 6*b* along the longitudinal axis A of said movable core 13. In this phase illustrated in FIG. 6*b*, the current $I_f$ is not high enough for the second force $F_2$ due to the part of the forward flux passing in the second portion 13*d* of said movable core 13 to be greater than the first force $F_1$ due to the magnetic flux $F_M$ and the part of the forward flux flowing through the first portion 13*c* of the movable core 13 ($F_1$>$F_2$). The overall resultant force F on the movable core 13 is still directed upward parallel to the axis A and maintains said movable core 13 in its first abutment position.

Figure 6C:
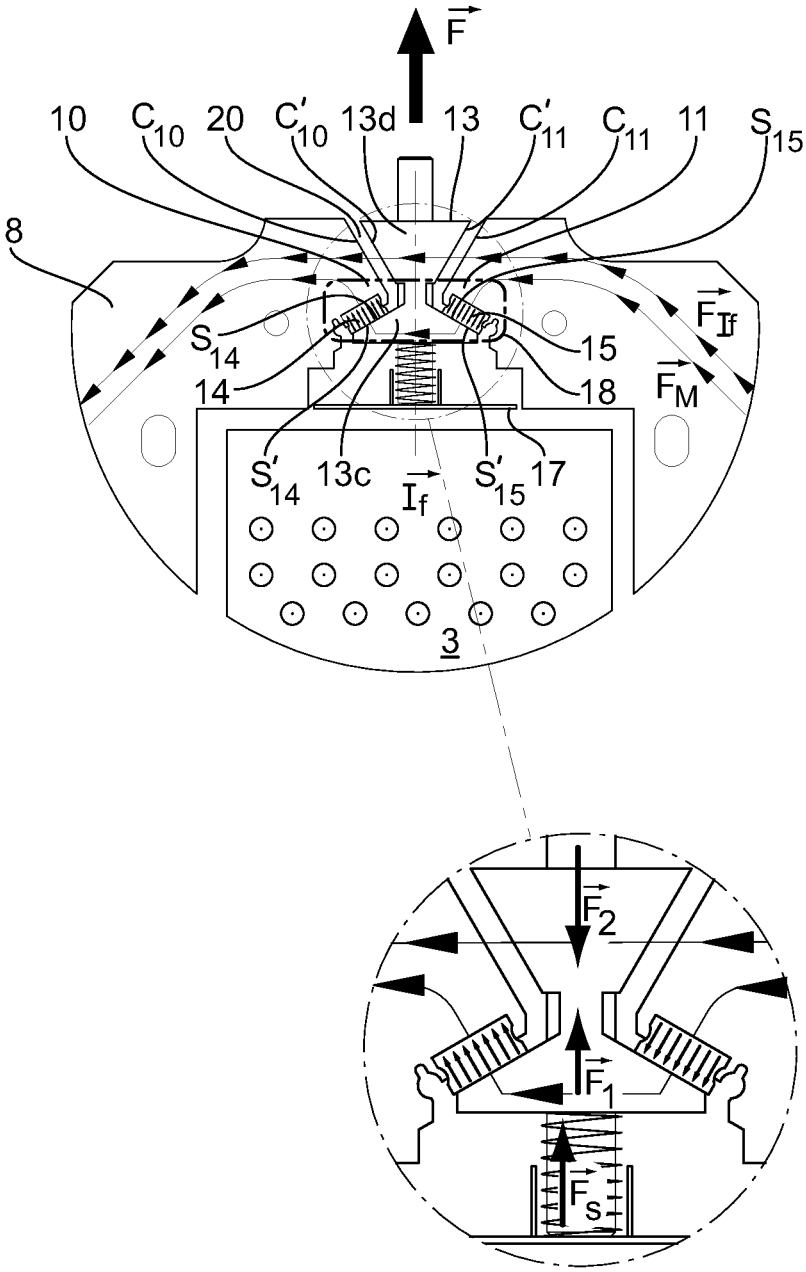
FIG. 6*c* is an enlarged view of the electromechanical release mechanism illustrated in FIG. 5 in a third phase.

In the third phase illustrated in FIG. 6*c*, the forward current $I_f$ increases and the part of the forward flux $F_{If}$ passing through the second portion 13*d* of the movable core 13 becomes greater. In this phase, the second force $F_2$ is greater than the first force $F_1$ ($F_1$<$F_2$), that is possible due to the geometry of the main frame 8 and the movable core 13, particularly due to the fourth characteristic and the fact that the force depends on the area through which flows the flux. The overall resultant force F on the movable core 13 should then be directed downward parallel to the axis A and should move the movable core 13 into its second abutment position and hence open the circuit interrupting device 2. But, in the described embodiment, the spring force $F_S$ due to the reset spring 16 is still sufficient so that the overall resultant force F on the movable core 13 is again directed upward along the longitudinal axis A of the movable core 13 and maintains the movable core 13 in its first abutment position ($F_1$+$F_S$>$F_2$). The circuit interrupting device remains closed.

In the last phase, the forward current $I_f$ keeps increasing and exceeds a forward limit value. The second force $F_2$ then becomes greater than the combination of the first force $F_1$ and the spring force $F_S$, the movable core 13 is then moved downward towards its second abutment position thus opening the circuit interrupting device.

The forward limit value is determined by the geometry of the movable core 13 and the main frame 8 and the magnetic moment of the permanent magnets 14, 15. In the described embodiment, the forward limit value for the forward current $I_f$ to open the circuit interrupting device can be adjusted by adjusting the spring force $F_S$ by for example compressing or stretching the reset spring 16. Preferably, this forward limit value is very high and the circuit interrupting device won't be opened by a short circuit in the forward direction. For example and preferably, this limit value is 100 kA.

Figure 7:
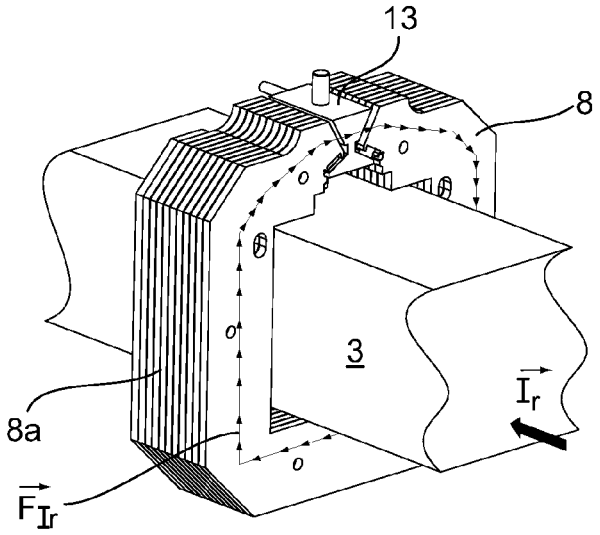
FIG. 7 shows the electromechanical release mechanism according to the invention when a reverse current is flowing through the circuit interrupting device illustrated in FIG. 1.

Finally, FIGS. 7, 8*a* and 8*b* illustrate the state of the release mechanism when a reverse current $I_r$ flows through the circuit power line 3 and the circuit interrupting device 2. As shown in the figures, the reverse current $I_r$ is perpendicular to the plan of the paper and directed towards the table.

As with the forward current, the reverse current $I_r$ generates a reverse flux $F_{Ir}$ through the main frame 8 and the movable core 13. But according to the right-hand grip rule, this current flux $F_{Ir}$ flows in the opposite direction from the magnetic flux $F_M$. In the drawings, the current flux $F_{Ir}$ flows clockwise through the main frame 8 and movable core 13.

The reverse flux $F_{Ir}$ cannot pass through the first portion 13*c* of the movable core 13 because of the magnetic flux $F_M$ flowing in the opposite direction. So, the reverse flux $F_{Ir}$ flows through the second portion 13*d* of the movable core 13. The magnetic flux $F_M$ creates a first force $F_1$ on the movable core 13 upwardly directed parallel to the axis A while the reverse flux $F_{Ir}$ creates a second force $F_2$ on the movable core 13 downwardly directed parallel to the axis A. The release mechanism will then open the circuit interrupting device when the second force $F_2$ is greater than the first force $F_1$ plus the spring force $F_S$, that is when the reverse current $I_r$ exceeds a reverse limit value.

One can say that the reverse flux $F_{Ir}$ increases to progressively cancel out the magnetic flux $F_M$. Moreover, some of the magnetic flux $F_M$ is diverted to also pass clockwise through the second portion 13*d* of the movable core 13, thus helping opening the circuit interrupting device.

The release mechanism according to the invention has to operate correctly even when the reverse current flowing through the circuit power line 3 increases greatly very quickly (short circuit). In this case, it can happen that the reverse current flux $F_{Ir}$ being so great passes through both the first and the second portion 13*c*, 13*d* of the movable core, effectively trying to demagnetize the permanent magnets 14, 15. The entire movable core 13, its first and its second portions 13*c*, 13*d* alike, is then saturated in the same direction. Reference numeral 19 designates in FIG. 8*b* the schematic saturation zone around the whole movable core 13. In this saturated case, the first force $F_1$ due to the flux passing through the first portion 13*c* is upwardly directed parallel to the axis A and is related to the area of the first common area of the first contact surfaces $S_{14}$, $S_{15}$, $S'_{14}$, $S'_{15}$ times the square of the said flux density. In the same way, the second force $F_2$ due to the flux passing through the second portion 13*d* of the movable core 13 is downwardly directed parallel to the axis A and is related to the area of the second common area of the second contact surfaces $C_{10}$, $C_{11}$, $C'_{10}$, $C'_{11}$ time the square of the said flux density. However, the area of the said second common area is bigger than the area of the first common area (see fourth characteristic on the geometry of the main frame 8 and the movable core 13). Therefore, the second force $F_2$ is bigger than the first force $F_1$. This is further ensured by the fact that the air gap 20 between the second contact surfaces $C_{10}$, $C_{11}$, $C'_{10}$, $C'_{11}$ of respectively the first and second extremities 10, 11 and the movable core 13 is conformed so that, when the movable core 13 is saturated, the amount of fringing and losses of the flux, hence the force, is minimal, so that the second force $F_2$ can really be bigger than the first force $F_1$. The movable core 13 is then moved into its second abutment position, opening the circuit interrupting device.

Preferably, the release mechanism according to the invention is designed to open the open the circuit interrupting device when the reverse current exceeds a reverse limit value of a few thousand amperes. This limit value is determined by the geometry of the movable core 13 and the main frame 8 and the magnetic moment of the permanent magnets 14, 15. In the described embodiment, this limit value also depends on the reset spring 16.

Once the movable core 13 has been displaced in its second abutment position, the reset spring 16 will ensure that said movable core 13 is pushed back into its first abutment position. Other known suitable means to reset the movable core in its first abutment position can clearly be used It is clear that the forward limit value and the reverse limit value are different, with the reverse one being lower than the forward, because in the forward direction, there is the first phase, during which the forward flux due to the current reinforces the magnetic flux due to the magnets holding more strongly the movable core in its first abutment position.

Upon reading the above description, it will be clear for the person of ordinary skill in the art that the characteristics of the release mechanism 1 according to the invention, such as the limit values depending on the direction of the current for opening the circuit interrupting device can be adjusted by choosing stronger or weaker permanent magnets 14, 15, by adjusting the resistance of the reset spring 16 and by changing the geometry of the main frame 8 and the movable core 13 so that they become more or less saturated more or less quickly.

We therefore obtain a release mechanism to be used in a circuit interrupting device that opens the said circuit interrupting device when a reverse current exceeds a first predetermined value, but leave the circuit interrupting device closed when a forward current is flowing through it, opening it only if the forward current exceeds a very high limit value to protect the circuit interrupting device. Contrary to the usual release mechanism, the fault conditions of the release mechanism according to the invention are different depending on the direction of the current flowing through it.

The invention claimed is:

1. A release mechanism for a circuit interrupting device, the release mechanism comprising:

a ferromagnetic main frame through which a current can flow; and a ferromagnetic movable core configured to be translated in an opening of the main frame between a first position in which the circuit interrupting device remains closed and a second position in which the circuit interrupting device is opened, the release mechanism being configured to use flux generated inside the main frame by the current flowing through the main frame to displace the movable core between the first position and the second position; and at least two permanent magnets mounted on the main frame on each side of the opening and relatively oriented so as to generate a unidirectional unique magnet flux inside the main frame and the movable core, the magnet flux creating a first force on the movable core that maintains the movable core in the first position, wherein a first current is defined as a current flowing through the main frame and generating a first flux inside the main frame and the movable core in the same direction as the magnetic flux, a predetermined first limit value is defined in connection with the first current, a second current is defined as a current flowing through the main frame and generating a second flux inside the main frame and the movable core in the direction opposite to the magnetic flux, a predetermined second limit value is defined in connection with the second current, the permanent magnets, the movable core and the main frame are configured so that the movable core is displaced from the first position into the second position when the first current exceeds the predetermined first limit value, or when a second current exceeds the predetermined second limit value, and wherein the second limit value is different than the first limit value.

2. The release mechanism according to claim 1, wherein the movable core presents a first portion and a second portion configured so that a flux flowing through the first portion displaces the movable core in the first position while a flux flowing through the second portion displaces the movable core in the second position, and the permanent magnets and the movable core are configured so that the magnetic flux flows entirely through the first portion.

3. The release mechanism according to claim 2, wherein the first and second portions of the movable core present respectively first and second contact surfaces designed to cooperate respectively with first and second contact surfaces on the main frame to determine respectively the first and second positions of the movable core in the opening.

4. The release mechanism according to claim 3, wherein the first contact surfaces of both the main frame and the first portion of the movable core are parallel and of the same area, the first contact surfaces of the main frame and the first portion being configured so that a flux flowing inside the main frame and passing through the first contact surfaces creates a force on the first portion of the movable core attracts the first contact surfaces against each other, thus moving the movable core into the first position, and the second contact surfaces of both the main frame and the second portion of the movable core are parallel and of the same area, the area of the second contact surfaces being bigger than the area of the first contact surfaces, the second contact surfaces being configured so that a flux flowing inside the main frame and passing through the second contact surfaces creates a force on the second portion of movable core that attracts the second contact surfaces against each other, thus moving the movable core into the second position.

5. The release mechanism according to claim 2, wherein the first and second portions of the movable core are two cones of opposite direction.

6. The release mechanism according to claim 2, wherein the first and second portions together form a sphere.

7. The release mechanism according to claim 2, wherein the first limit value is of a different order of magnitude than the second limit value.

8. The release mechanism according to claim 2, wherein the first limit value is between 2000 and 6000 amperes.

9. The release mechanism according to claim 2, wherein the second limit value is greater than 90000 amperes.

10. The release mechanism according to claim 2, wherein the main frame is made of stacked ferromagnetic laminations insulated from each other by an insulating coating.

11. The release mechanism according to claim 2, wherein the main frame is made of silicon steel.

12. The release mechanism according to claim 2, further comprising a spring configured to maintain the movable core in the first position.

13. A circuit interrupting device comprising a release mechanism according to claim 2.

14. The release mechanism according to claim 1, wherein the first limit value is of a different order of magnitude than the second limit value.

15. The release mechanism according to claim 1, wherein the first limit value is between 2000 and 6000 amperes.

16. The release mechanism according to claim 1, wherein the second limit value is greater than 90000 amperes.

17. The release mechanism according to claim 1, wherein the main frame is made of stacked ferromagnetic laminations insulated from each other by an insulating coating.

18. The release mechanism according to claim 1, wherein the main frame is made of silicon steel.

19. The release mechanism according to claim 1, further comprising a spring configured to maintain the movable core in the first position.

20. A circuit interrupting device comprising a release mechanism according to claim 1.

21. The release mechanism according to claim 1, wherein the movable core is selectively displaced when the first current exceeds the predetermined first limit value and when the second current exceeds the predetermined second limit value.

22. The release mechanism according to claim 1, wherein the circuit interrupting device is a DC circuit interrupting device.

23. The release mechanism according to claim 1, wherein the circuit interrupting device is automatically opened when one of the first current and the second current exceeds the predetermined first limit value and the predetermined second limit value, respectively.

* * * * *